US005386806A

United States Patent [19]

Allen et al.

[11] Patent Number: 5,386,806

[45] Date of Patent: Feb. 7, 1995

[54] CAM MECHANISMS

[75] Inventors: Jeffrey Allen, Attleborough, United Kingdom; William J. Hurr, Graz, Austria

[73] Assignee: Group Lotus Limited, Norfolk, United Kingdom

[21] Appl. No.: 95,816

[22] PCT Filed: Feb. 15, 1991

[86] PCT No.: PCT/GB91/00232

§ 371 Date: Dec. 1, 1992

§ 102(e) Date: Dec. 1, 1992

[87] PCT Pub. No.: WO91/12415

PCT Pub. Date: Aug. 22, 1991

Related U.S. Application Data

[63] Continuation of Ser. No. 920,388, Dec. 1, 1992, abandoned.

[30] Foreign Application Priority Data

Feb. 16, 1990 [GB] United Kingdom ..... 9003603

[51] Int. Cl.[6] ..... F01L 1/24; F01L 1/34

[52] U.S. Cl. ..... 123/90.16; 123/90.44

[58] Field of Search ..... 123/90.15, 90.16, 90.17, 123/90.22, 90.27, 90.39, 90.4, 90.41, 90.44

[56] References Cited

U.S. PATENT DOCUMENTS

| | | | |
|---|---|---|---|
| Re. 33,411 | 10/1990 | Inoue et al. | 123/198 |
| Re. 33,967 | 6/1992 | Honda et al. | 123/90.16 |
| 3,875,908 | 4/1975 | Ayres | 123/90.43 |
| 4,151,817 | 5/1979 | Mueller | 123/90.16 |
| 4,203,397 | 5/1980 | Soeters, Jr. | 123/90.16 |
| 4,222,354 | 9/1980 | Uitvlugt | 123/90.16 |
| 4,227,494 | 10/1980 | Uitvlugt | 123/90.16 |
| 4,230,076 | 10/1980 | Mueller | 123/90.16 |
| 4,305,356 | 12/1981 | Walsh | 123/198 |
| 4,380.219 | 4/1983 | Walsh | 123/198 |
| 4,411,229 | 10/1983 | Curtis et al. | 123/90.16 |
| 4,475,489 | 10/1984 | Honda | 123/90.16 |
| 4,537,165 | 8/1985 | Honda et al. | 123/90.16 |
| 4,559,909 | 12/1985 | Honda et al. | 123/90.28 |
| 4,576,128 | 3/1986 | Kenichi | 123/90.16 |
| 4,587,936 | 5/1986 | Matsuura et al. | 123/315 |

(List continued on next page.)

FOREIGN PATENT DOCUMENTS

| | | |
|---|---|---|
| 0016068B1 | 2/1983 | European Pat. Off. . |
| 0213758 | 3/1987 | European Pat. Off. . |

(List continued on next page.)

*Primary Examiner*—Willis R. Wolfe
*Assistant Examiner*—Weilun Lo
*Attorney, Agent, or Firm*—Fulwider Patton Lee & Utecht

[57] ABSTRACT

Cam mechanisms are provided for controlling valve means, and in particular relate to a cam mechanism for controlling the inlet and/or exhaust valve of an internal combustion engine. The cam mechanism comprises cam shaft means (10) having first (50) and second (51) cam means mounted thereon for rotation therewith and first (52) and second (62) finger followers having first (59) and second (61) follower means respectively arranged to follow the surface of the first (50) and second (51) cam means, the first (52) and second (62) finger followers being rockable about fulcrum means (54 and 66) which holds the finger followers (52 or 62) in engagement with the cam means (50 or 51) and the valve means (14) thereby permitting control of the valve means (14) by the cam means. The first cam means (50), first follower means (59) and first finer follower (52) comprise a first short duration cam mechanism for low speeds of the engine, the fulcrum means (54 and 66) being in a first position at low speeds in which the first cam follower (59) is in engagement with the first cam means (50). At higher engine speeds the fulcrum means (66 and 55) operates in a second position wherein the second cam means (51), second follower means (61) and second finger follower (62) act as a long duration cam mechanism, the second cam follower (61) being in engagement with the second cam means (51).

15 Claims, 12 Drawing Sheets

U.S. PATENT DOCUMENTS

| | | | |
|---|---|---|---|
| 4,718,379 | 1/1988 | Clark | 123/90.39 |
| 4,724,802 | 2/1988 | Ishii | 123/198 F |
| 4,727,831 | 3/1988 | Nagahiro et al. | 123/90.16 |
| 4,741,297 | 5/1988 | Nagahiro et al. | 123/90.16 |
| 4,759,321 | 7/1988 | Matsumoto et al. | 123/90.15 |
| 4,762,096 | 8/1988 | Kamm et al. | 123/90.16 |
| 4,779,589 | 10/1988 | Matsuura et al. | 123/90.15 |
| 4,905,639 | 3/1990 | Konno | 123/90.16 |
| 4,960,110 | 10/1990 | Nishimura et al. | 123/90.17 |
| 5,018,487 | 5/1991 | Shinkai | 123/90.16 |
| 5,020,488 | 6/1991 | Watanabe | 123/90.16 |
| 5,025,761 | 6/1991 | Chen | 123/90.16 |
| 5,040,651 | 8/1991 | Hampton et al. | 192/45.1 |
| 5,111,781 | 5/1992 | Kaku et al. | 123/90.16 |
| 5,113,813 | 5/1992 | Rosa | 123/90.16 |
| 5,148,783 | 9/1992 | Shinkai et al. | 123/90.16 |

FOREIGN PATENT DOCUMENTS

| | | |
|---|---|---|
| 0213759 | 3/1987 | European Pat. Off. . |
| 0258061 | 3/1988 | European Pat. Off. . |
| 0259106 | 3/1988 | European Pat. Off. . |
| 0262269 | 4/1988 | European Pat. Off. . |
| 0264253 | 4/1988 | European Pat. Off. . |
| 0265191 | 4/1988 | European Pat. Off. . |
| 0265281 | 4/1988 | European Pat. Off. . |
| 0265282 | 4/1988 | European Pat. Off. . |
| 0267696 | 5/1988 | European Pat. Off. . |
| 0275713 | 7/1988 | European Pat. Off. . |
| 0275714 | 7/1988 | European Pat. Off. . |
| 0275715 | 7/1988 | European Pat. Off. . |
| 0276531 | 8/1988 | European Pat. Off. . |
| 0276532 | 8/1988 | European Pat. Off. . |
| 0276533 | 8/1988 | European Pat. Off. . |
| 0276577 | 8/1988 | European Pat. Off. . |
| 0291357 | 11/1988 | European Pat. Off. . |
| 0293209 | 11/1988 | European Pat. Off. . |
| 0297791 | 1/1989 | European Pat. Off. . |
| 0300679 | 1/1989 | European Pat. Off. . |
| 0312216 | 4/1989 | European Pat. Off. . |
| 0317371 | 5/1989 | European Pat. Off. . |
| 0317372 | 5/1989 | European Pat. Off. . |
| 0318303 | 5/1989 | European Pat. Off. . |
| 0323233 | 7/1989 | European Pat. Off. . |
| 0338729 | 10/1989 | European Pat. Off. . |
| 0342007 | 11/1989 | European Pat. Off. . |
| 0342051 | 11/1989 | European Pat. Off. . |
| 0343931 | 11/1989 | European Pat. Off. . |
| 0347211 | 12/1989 | European Pat. Off. . |
| 0353862 | 2/1990 | European Pat. Off. . |
| 0353863 | 2/1990 | European Pat. Off. . |
| 0353988 | 2/1990 | European Pat. Off. . |
| 0359363 | 3/1990 | European Pat. Off. . |
| 0364069A1 | 4/1990 | European Pat. Off. . |
| 0364081 | 4/1990 | European Pat. Off. . |
| 0405927A1 | 1/1991 | European Pat. Off. . |
| 0442460A1 | 8/1991 | European Pat. Off. . |
| 2510182 | 3/1983 | France . |
| 2753197 | 6/1978 | Germany . |
| 2952037 | 6/1981 | Germany . |
| 3119133A1 | 12/1982 | Germany . |
| 3347680 | 8/1984 | Germany . |
| 3613945A1 | 10/1986 | Germany . |
| 1476357 | 6/1977 | United Kingdom . |
| 1551360 | 8/1979 | United Kingdom . |
| 2017207A | 10/1979 | United Kingdom . |

CAM MECHANISMS

This application is a continuation of application Ser. No. 07/920,388, filed Dec. 1, 1992, abandoned.

This invention relates to cam mechanisms for controlling valve means, and relates in particular to cam mechanisms for controlling the inlet and/or exhaust valves of an internal combustion engine, with the aim to improve the power, torque, fuel economy and emissions output of said engine.

Cam design in an internal combustion engine is frequently the result of compromises between differing requirements of the combustion chambers of such an engine at different engine speeds and loadings.

For example, in a high output, multi-valve, spark ignition engine having a four-stroke cycle and which is designed to operate at high engine speeds, it is generally desirable to provide cams controlling the inlet valves which have a long valve opening period, in order to maximise the combustible charge drawn into the combustion chambers during the suction strokes of the engine. This has the advantage of improving the volumetric efficiency of the engine, thereby increasing the maximum power and torque outputs of the engine. Cams providing a long valve opening period are referred to herein as long duration cams.

However, if such an engine is operated at speeds below that at which maximum torque is developed, since the inlet valves are open for a relatively long period, some of the combustible charge drawn into each combustion chamber on its suction stroke can be forced back through the valve before it closes. This effect clearly reduces the volumetric efficiency, and hence the output, of the engine. It also causes uneven engine idling and low speed operation, and also makes exhaust emissions more difficult to control.

It is therefore desirable to provide a cam mechanism for use only at low engine speeds which has a relatively short operating or opening period, i.e. a short duration cam lobe.

There have already been a number of proposals for variable valve timing devices in which means is provided for varying the duration of the opening of the valve in an internal combustion engine.

For example in U.S. Pat. No. 4,727,831 a pair of adjacent valves are controlled to operate together by means of rocker shafts and cams. The two valves are normally driven from the camshaft by two low-speed cams operating on separate rocker arms for each valve but a separate third rocker arm is mounted between the two aforesaid rocker arms and is arranged to be driven by a high-speed cam. When it is desired to operate the valves via the high-speed cam the third rocker arm is selectively interconnected to the other two rocker arms so that the valves are both driven via the third rocker arm.

In U.S. Pat. No. 4,475,489 a valve is driven either by a first rocker arm driven by a high-speed cam or a second rocker arm driven by a low-speed cam and means is provided to move the two rocker arms between operative and inoperative positions whereby the valve is driven by either of the rocker arms. There is an overlap between the high-speed and low-speed positions where both rocker arms are driving the valve in order to overcome the problem that if there is no overlap both of the rocker arms will be at intermediate positions at which an undesirable impact takes place between the valve and the rocker arms.

We aim to provide an alternative variable cam mechanism which avoids the problem caused by taking both of the rocker arms out of engagement one after the other and the problem of U.S. Pat. No. 4,727,831 where all the rocker arms are in contact continuously with the cams which means that the cams have to provide power to drive all the rocker arms all the time.

Accordingly the invention provides an internal combustion engine having valve means and a cam mechanism for controlling the valve means comprising camshaft means having first and second cam means mounted thereon for rotation therewith and first and second finger followers having first and second follower means respectively arranged to follow the surface of the first and second cam means, the first and second finger followers being rockable about fulcrum means which holds the finger followers in direct or indirect engagement with the cam means and the valve means thereby permitting control of the valve means by the cam means, in which the first cam means, first follower means and first finger follower comprise a first short duration cam mechanism for low speeds of the engine, the respective fulcrum means being in a position at low speeds where the first cam follower is in engagement with the first cam means, and in which the second cam means, second follower means and second finger follower comprise a second long duration cam mechanism for high speeds of the engine, the fulcrum means being operable between the first position where the second cam follower is out of engagement with the second cam means and a second position where the second cam follower is in engagement with the second cam means.

The present invention also provides an internal combustion engine having valve means and a cam mechanism for controlling the valve means comprising camshaft means having first and second cam means mounted thereon for rotation therewith and first and second finger followers rockable about fulcrum means, the first finger follower having first follower means arranged to follow the surface of the first cam means when the first finger follower is held in direct or indirect engagement with the cam means by the fulcrum means and the second finger follower having second follower means arranged to follow the surface of the second cam means when the second finger follower is held in direct or indirect engagement with the cam means, in which, the first cam means, first follower means and first finger follower comprise a first short duration cam mechanism for low speeds of the engine, the second cam means, second follower means and second finger follower comprise a second long duration cam mechanism, and in which the fulcrum means comprises movable fulcrum means about which the second finger follower is rockable, said movable fulcrum means being movable between a first position where the second follower means is out of engagement with the second cam means and a second position where the second cam follower is in engagement with the second cam means, characterized in that the fulcrum means comprises a fixed fulcrum means about which the first finger follower is rockable for all positions of the movable fulcrum means.

Preferably the first follower means of the first finger follower engages the base circle of the first cam means irrespective of whether the second follower means is in or out of engagement with the second cam means.

In one arrangement the fulcrum means for the second cam mechanism comprises an actuator piston movable between two positions in a bore in response to changes in pressure in a chamber surrounding the piston.

It is further preferred that a latching means is provided to latch the actuator piston releasably in either of its first or second positions.

The latching means may comprise a latching piston movable in a direction transversely of the actuator piston and engageable with a recess in the bore.

In a preferred embodiment a pair of adjacent valves may be driven by individual finger followers provided in the first cam mechanism, the second cam mechanism having a single finger follower operable to drive both of the adjacent valves.

Preferably two finger followers of the first cam mechanism are joined together adjacent where they make driving engagement with the valves by a link member extending parallel to the camshaft means and the second finger follower is situated between the two said finger followers and drives the link member.

There now follows descriptions of specific embodiments of the invention, by way of example with reference being made throughout to the accompanying drawings, in which.

It is apparent that the invention may be applied both to inlet and exhaust valves of four stroke, spark ignition engines, and other internal combustion engines which have valves controlled by a cam mechanism in which selection of two or more cams is required.

Figure 1:
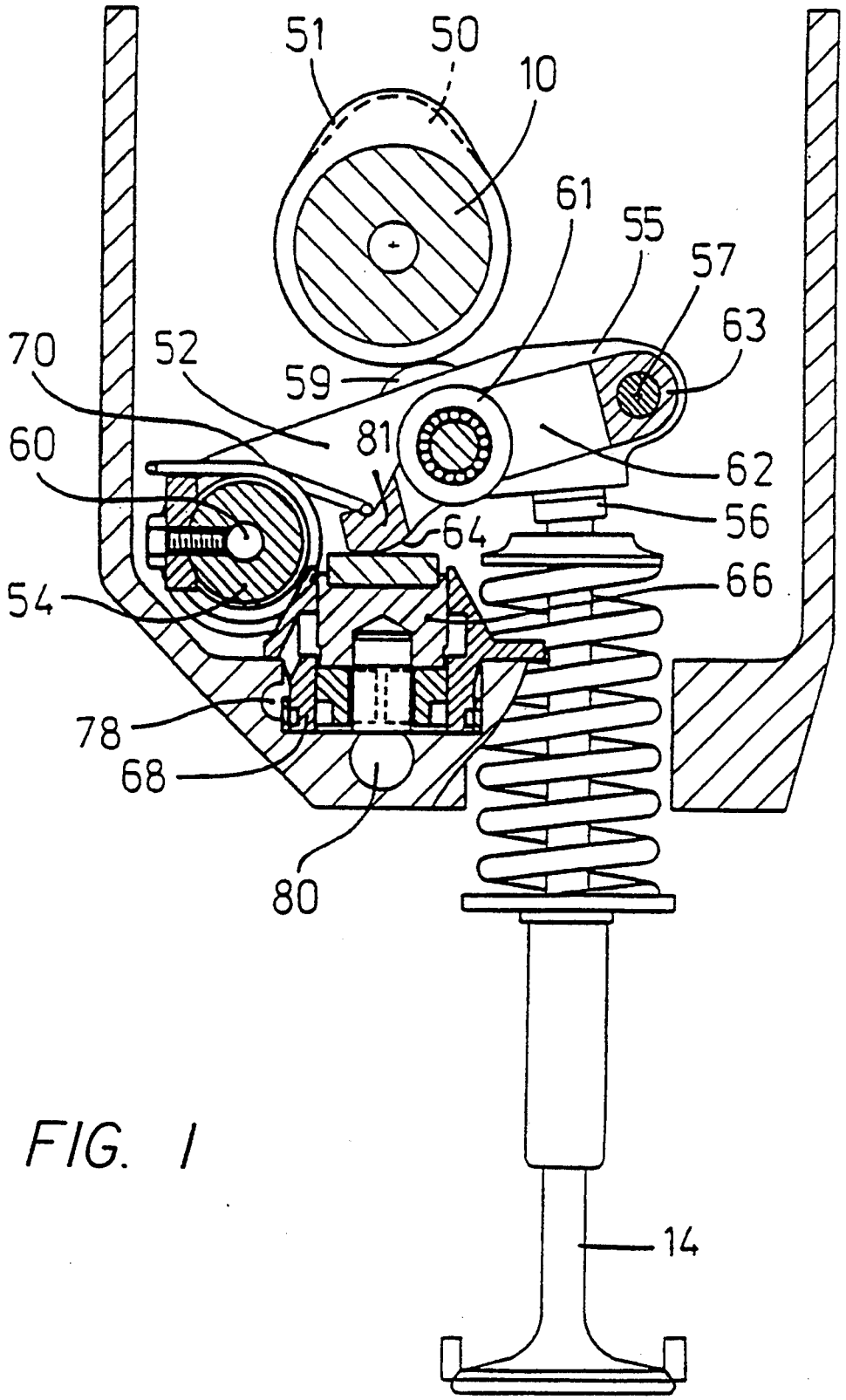
FIG. 1 shows a schematic side view of an embodiment of the invention.
Figure 2:
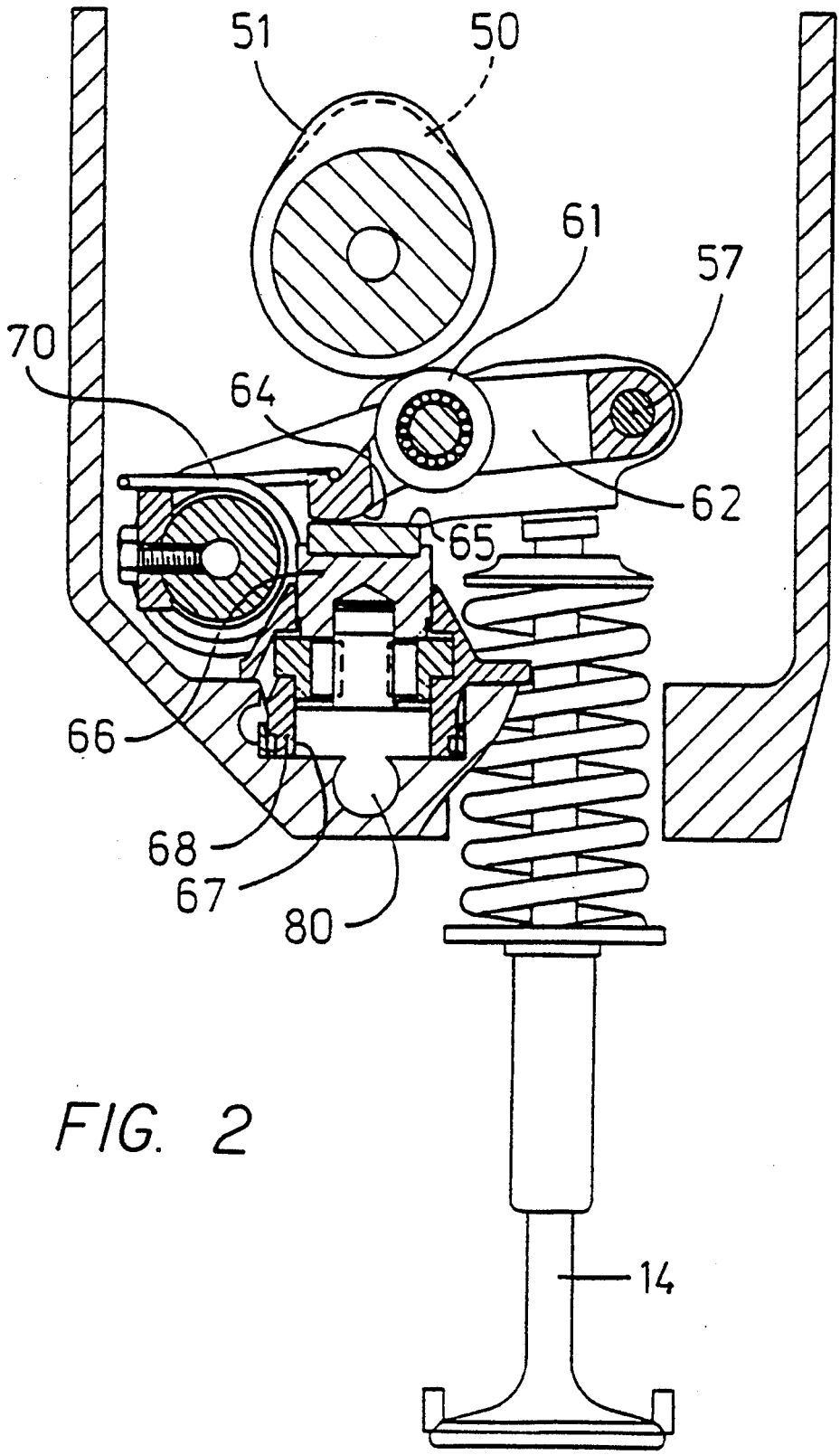
FIG. 2 shows the embodiment of FIG. 1 in another operational condition.
Figure 3:
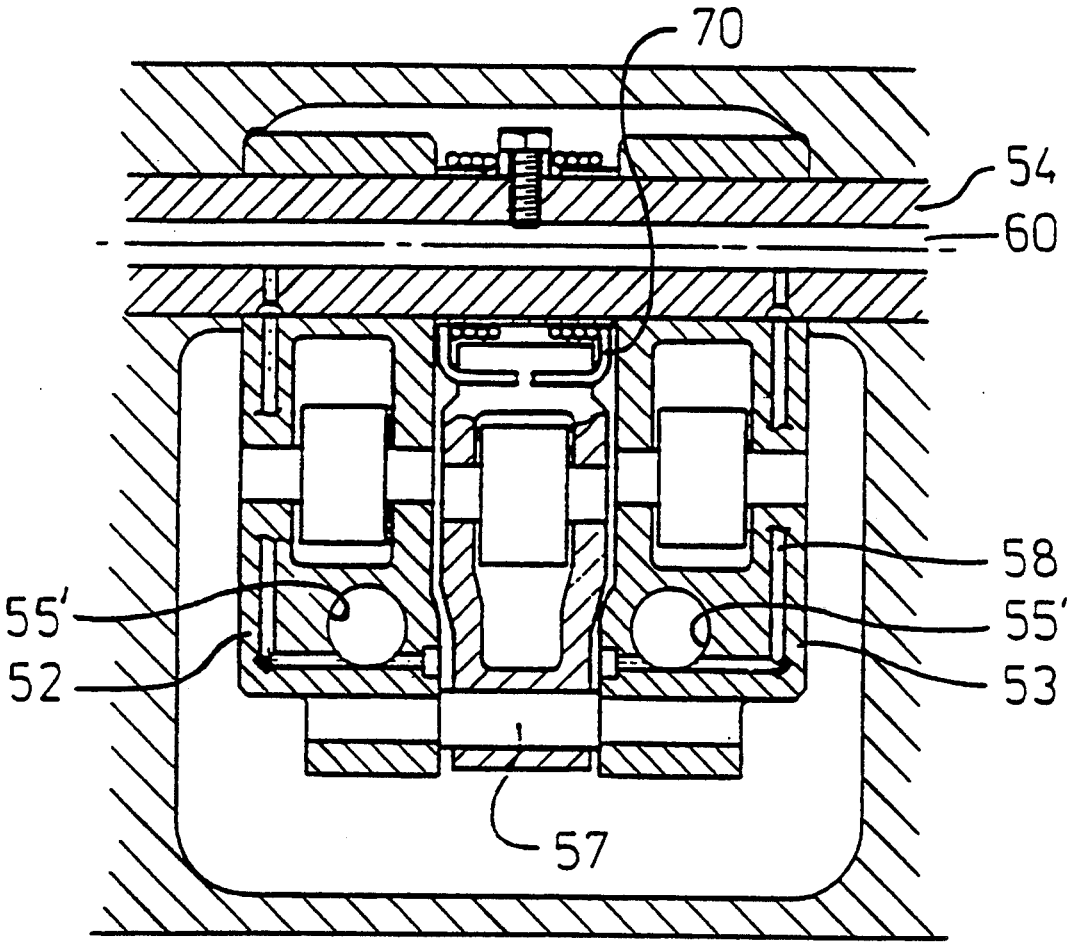
FIG. 3 shows a top view of the embodiment of FIG. 1.

In the embodiment shown in FIGS. 1 to 6 of the drawings the mechanism comprises a pair of valves 14. Only one valve is shown in FIGS. 1 and 2, the second lies immediately behind the first as shown in the figure. The valves 14 are selectively controlled by either a pair of low-lift cams 50 provided on cam shaft 10, or by a high-lift cam 51 provided on the cam shaft 10. A pair of low-lift finger followers 52 and 53 are pivotally mounted on rocker shaft 54. Cam followers 59 are provided on the finger followers 52 and 53 and co-operate with the low-lift cams 50. The cam followers 59 comprise rollers rotatably mounted on the finger followers. The outer end portions 55 of the finger followers 52 and 53 have a cylindrical bore 55' (see FIG. 3) which house hydraulic lash compensation elements 56 which bear on the upper end of the valve stems of the valves. The finger followers 52 and 53 are joined together by a cross-member 57 which locates in the end portions 55 of the finger followers 52 and 53.

A hydraulic supply 60 is provided in the rocker shaft 54 and supplies the hydraulic lash compensation elements 56 via a passageway 58 (see FIG. 3) in the finger followers 52 and 53, or, via a passageway in cross-member 57 and at last one passageway in at least one of the finger followers 52 or 53.

The high-lift cam 51 co-operates with a cam follower roller 61 pivotally mounted at an intermediate position in the length of a high-lift finger follower 62. An outward end portion 63 of the finger follower 62 is pivotally connected to the cross-member 57 and moves up and down with it. The cross-member 57 may be considered as being a connecting element connecting the high-lift finger follower 62 to the valves at certain conditions of operation.

Figure 4:
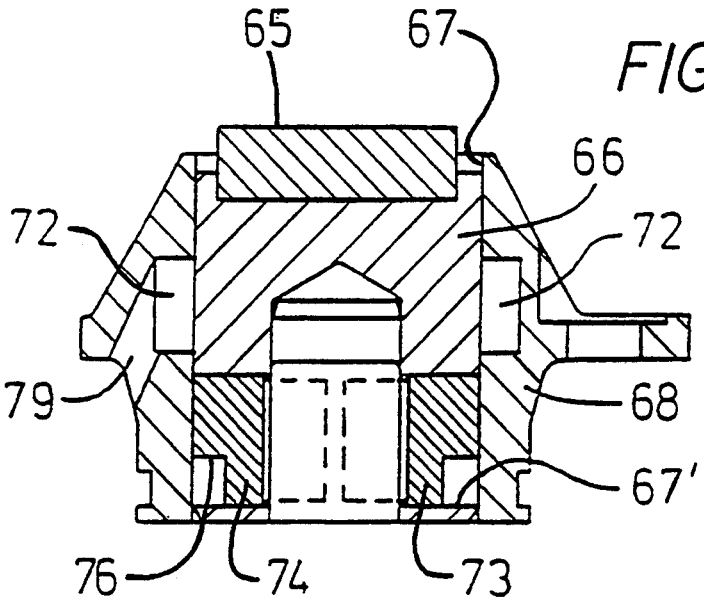
FIG. 4 shows a detail of the embodiment of FIG. 1.
Figure 5:
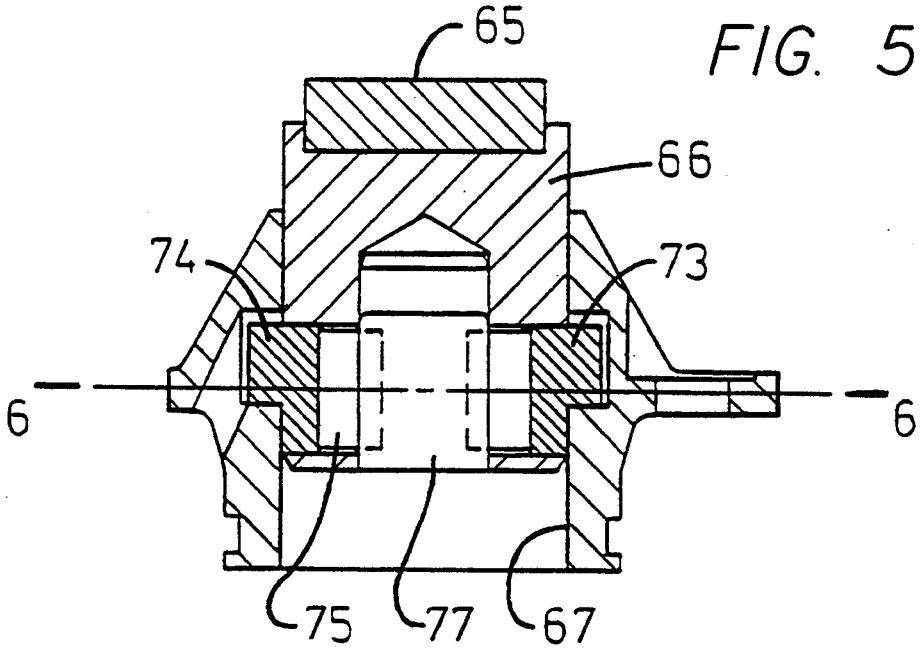
FIG. 5 shows a detail of the embodiment of FIG. 1 in another operational condition.
Figure 6:
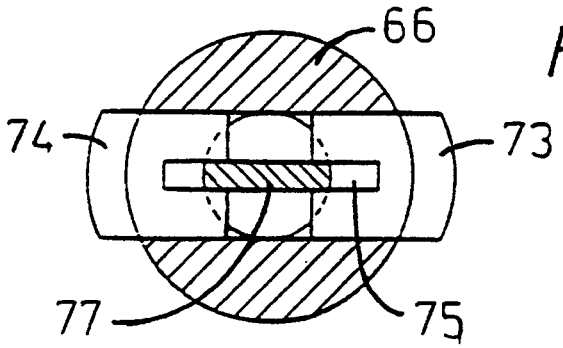
FIG. 6 is a section on line 6—6 of FIG. 5.

The piston 66 has a flat upper end 65 (see FIGS. 4 and 5) and the high lift finger follower 62 has a curved engagement portion 64 which bears against 65, but is not positively connected to it. The arrangement allows relative transverse movement between the follower 62 and piston 66 as well as rotational movement of follower 62 about its contact point with piston 66. In constant engagement with the end portion 81 of the finger follower 62 is return spring 70 which ensures constant engagement between surfaces 64 and 65 and also urges piston 66 into its retracted position. The piston 66 is movable between advanced and retracted positions in a bore 67 defined in a sleeve 68 which is inserted in a bore in the engine casting, for example in the cylinder head casting. The piston 66 is best shown in FIGS. 4, 5 and 6. The sleeve 68 has two opposed and aligned apertures, or alternatively a circumferential recess, 72 in its side walls, whose purpose will be described later. A pair of opposed pistons 73 and 74 are provided in the bore 67, in a transverse bore 67' provided in the piston 66, and extend transversely of the piston 66 and bore 67. The pistons 73 and 74 each have a slot 75 at their oppositely facing adjacent ends, and each carry a transversely extending spigot, or shoulder, 76 at their opposite spaced-apart ends. An alignment pin 77 engages with slots 75 in pistons 73 and 74 and ensures correct engaging alignment between shoulders 76 and recess 72. An oil gallery feed 80 communicates with the bottom end of the bore 67, beneath the piston 66, and another oil gallery feed 78 communicates with recess 72 and, via passage 79, onto the outer ends of pistons 73 and 74.

When the engine is running at a low speed pressurised oil is not supplied to the gallery feed 80 and the spring 70 keeps the piston 66, and hence the pistons 73 and 74, in their retracted positions. When the piston 66 is in its retracted position, shown in FIG. 1, the high-lift cam follower 61 is in a lowered position and does not contact the high-lift cam 51. Instead, the two low-lift cams 50 are in operative contact with the low-lift cam followers 59 and it is the low-lift cams which control the operation of the valves 14. The high-lift cam follower is not positively driven.

At high engine speeds oil is arranged to be supplied at pressure to the gallery feed 80. The pressure of the oil in the gallery feed 80 overcomes spring 70 and forces the piston 66 towards its advanced position. When the shoulders 76 of the pistons 73 and 74 register with the apertures 72 in the sleeve 68 the oil pressure acting on the inward facing ends of the pistons 73 and 74 moves the pistons away from each other with the shoulders 76 entering the apertures 72 and latching there.

The pistons 73, 74 may have an oil seal to assist this, and the bore 67 may have a non-circular cross-section, at least in the region of movement of the pistons 73, 74, so as to guide the pistons 73, 74 to assist location of the spigots 76 in the apertures 72.

As the piston 66 moves upwards to its advanced position, which is determined by the latching of the shoulders 76 in apertures 72, the high-lift finger follower 62, and its cam follower 61, are raised. When the advanced position shown in FIG. 2 is reached the cam follower 61 is in operative engagement with the cam 51 and controls the operation of the valves 14. The cross-member 57 located in the forward end portion 63 of finger follower 62 operates with finger followers 52 and 53 and urges the finger followers 52 and 53 downwards under control of the high-lift cam 51.

The low-lift cam followers 59 still contact the cams 50 for most of a revolution of the camshaft 10, except for the portion which corresponds to the protruding lug of the cam 51. In that portion of the revolution the lift event of the low-lift cam 50 is entirely within the lift event of the high-lift cam 51. Thus as the camshaft turns to the position where the lugs of the cams 50 and 51 approach their respective cam followers the high-lift cam 51 gets to its follower first and moves the finger followers 52, 53 downwards under control of the high-lift cam 51. The protruding lug of the low lift cam 50 does not actually touch its cam follower when the piston 66 is in its advanced position, thus not wasting energy by driving inactive elements.

When the oil pressure in gallery 80 is switched off and oil pressure is applied to gallery 78 the pistons 73 and 74 will be forced inwards so that the shoulders 76 clear the apertures 72 in the sleeve 68. The spring 70 then pushes the piston 66 to its retracted position.

It can thus be seen that the invention has fulcrum means, comprising the piston 66 and the rocker shaft 54 which allow rocking motion of the finger followers 52, 53 and 62. The fulcrum means operate in a first position for low engine speeds in which the cam followers 59 on the finger followers 52 and 53 engage with the cams 50, allowing control of the valves 14 by the cams 50. At higher speeds the fulcrum means moves to a second position in which the cam follower 61 on the finger follower 62 engages with the cam 51 to permit control of the valves 14 by the cam 51.

Since the hydraulic lash compensation is provided by elements 56 provided at the upper end of the valve stems, the same two hydraulic lash compensation elements 56 compensate for lash for both the low-lift finger followers 52, 53, and for the high-lift finger follower 62.

FIGS. 7, 8, 9 and 10 show alternative embodiments of pistons 66, 73 and 74. Similar reference numerals have been given to similar components shown in FIGS. 1 to 6.

Figure 8:
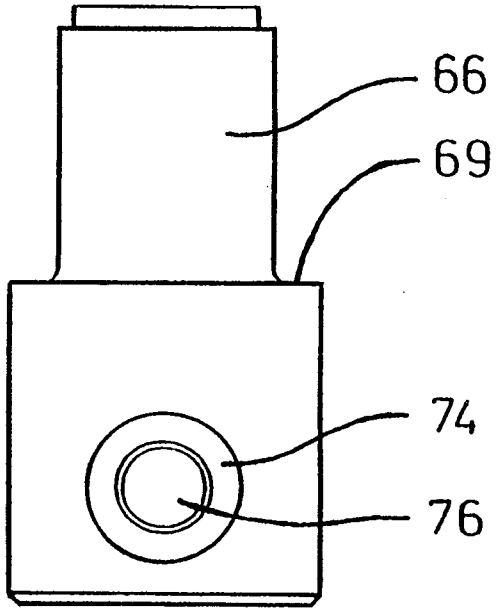
FIGS. 7 and 8 show a modification of the details of FIGS. 4 and 5.
Figure 7:
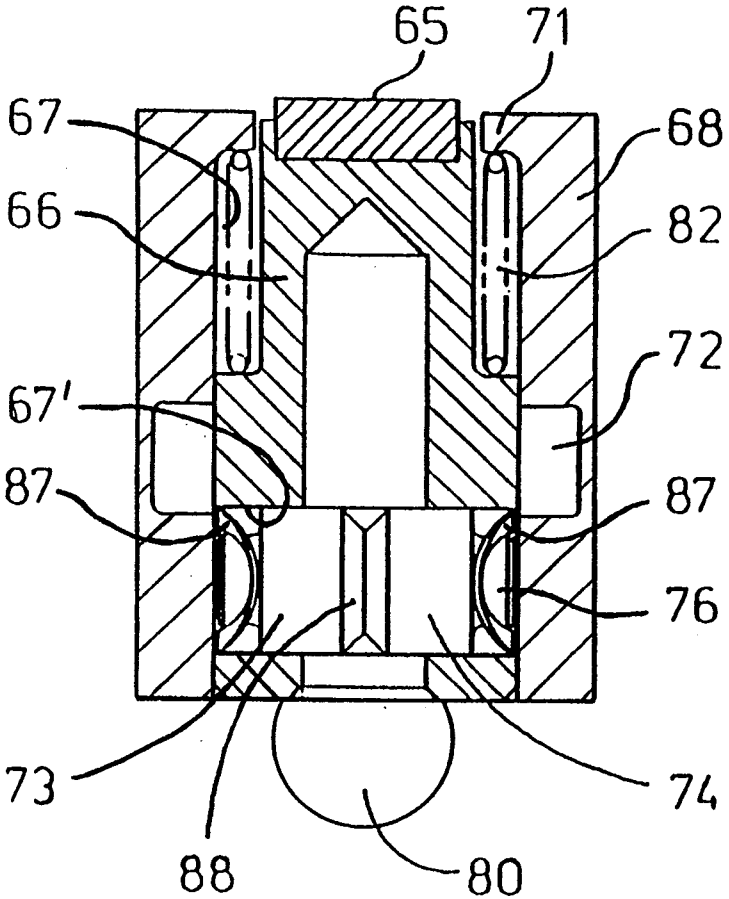

FIGS. 7 and 8 show return spring 82 being internal of sleeve 68, working between shoulder 69 of piston 66 and return lip 71 of sleeve 68. Spring 82 urges piston 66 to its retracted position, while a separate spring clip (not shown) maintains contact between surface 64 of high lift finger follower 62 and surface 65 of piston 66. FIG. 7 shows springs 87, located over spigots 76 of pistons 73 and 74, used to urge pistons 73 and 74 inwards instead of oil pressure from gallery 78. Chamfers 88 are provided on pistons 73 and 74 to allow oil pressure from gallery 80 adequate surface area to overcome the force from springs 87 and push pistons 73 and 74 outwards when required.

Figure 10:
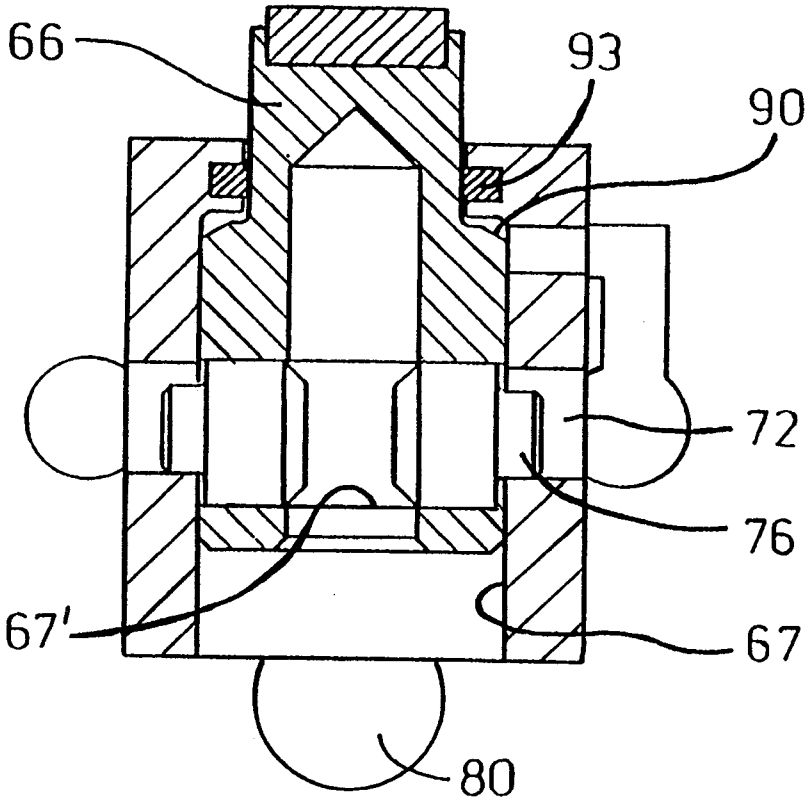
FIGS. 9 and 10 show another modification of the details of FIGS. 4 and 5.
Figure 9:
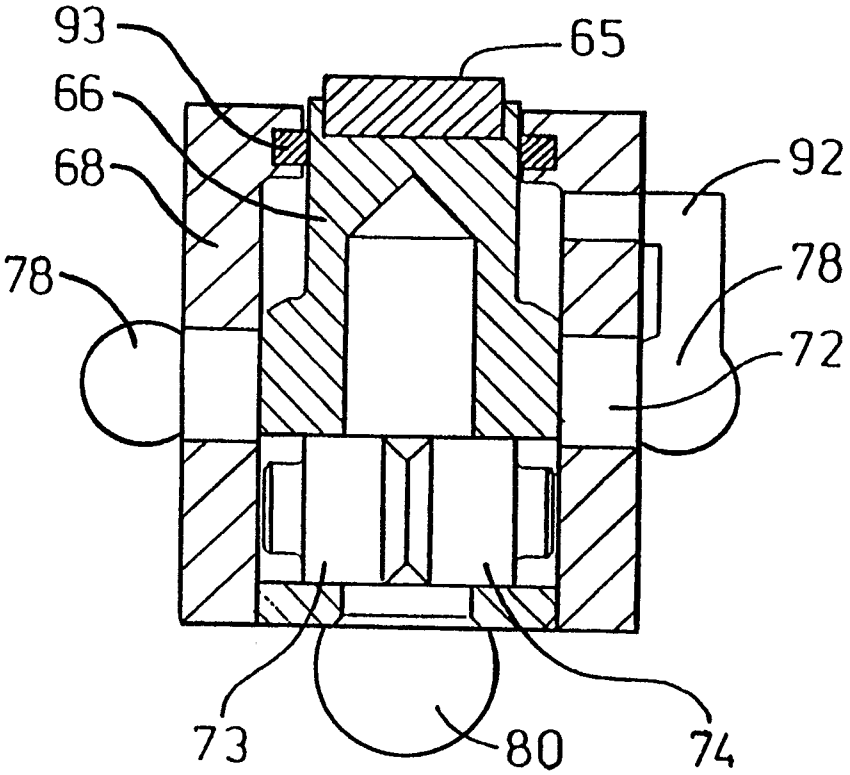

The embodiment shown in FIGS. 9 and 10 does away with the need for a spring element (70 and 82 in the previously described embodiments). Instead FIGS. 9 and 10 show an arrangement in which the piston 66 has a chamfered upper surface 90, and an additional oil passageway 92 is provided. The gallery 78 is open to the apertures 72 in the sleeve 68, and has an inlet 92 to the top of the sleeve 68. A seal 93 seals the sliding movement of the piston 66 relative to the sleeve 68.

FIG. 9 shows the piston 66 in its retracted condition in which oil pressure is supplied to gallery 78, but not gallery 80. To advance the piston to its advanced position shown in FIG. 10 oil under pressure is fed to gallery 80 and the oil pressure in gallery 78 is reduced or removed. A switching valve could perform this function. The piston 66 rises in the same manner as that of FIGS. 7 and 8. To retract the piston to its retracted position of FIG. 9 oil under pressure is fed to gallery 78, but not to gallery 80. The oil enters inlet 92 and acts on chamfered shoulder 90, forcing the piston 66 downwards. The oil also acts through apertures 72, forcing the pistons 73 and 74 together, unlatching them. Thus the need to use a spring element is eliminated by using oil pressure instead.

Figure 11:
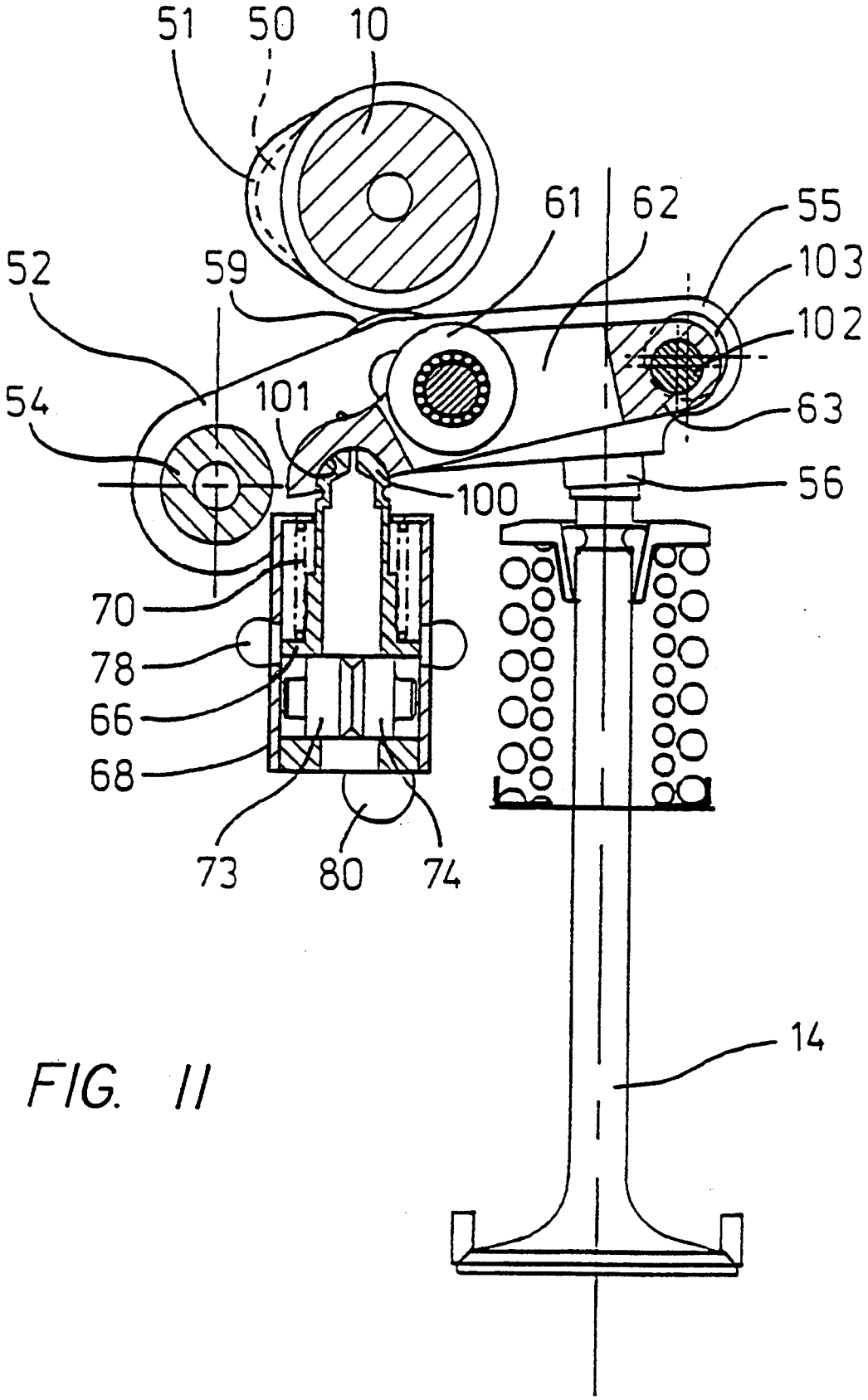
FIGS. 11 and 12 show a modification of the embodiment of FIG. 1.
Figure 12:
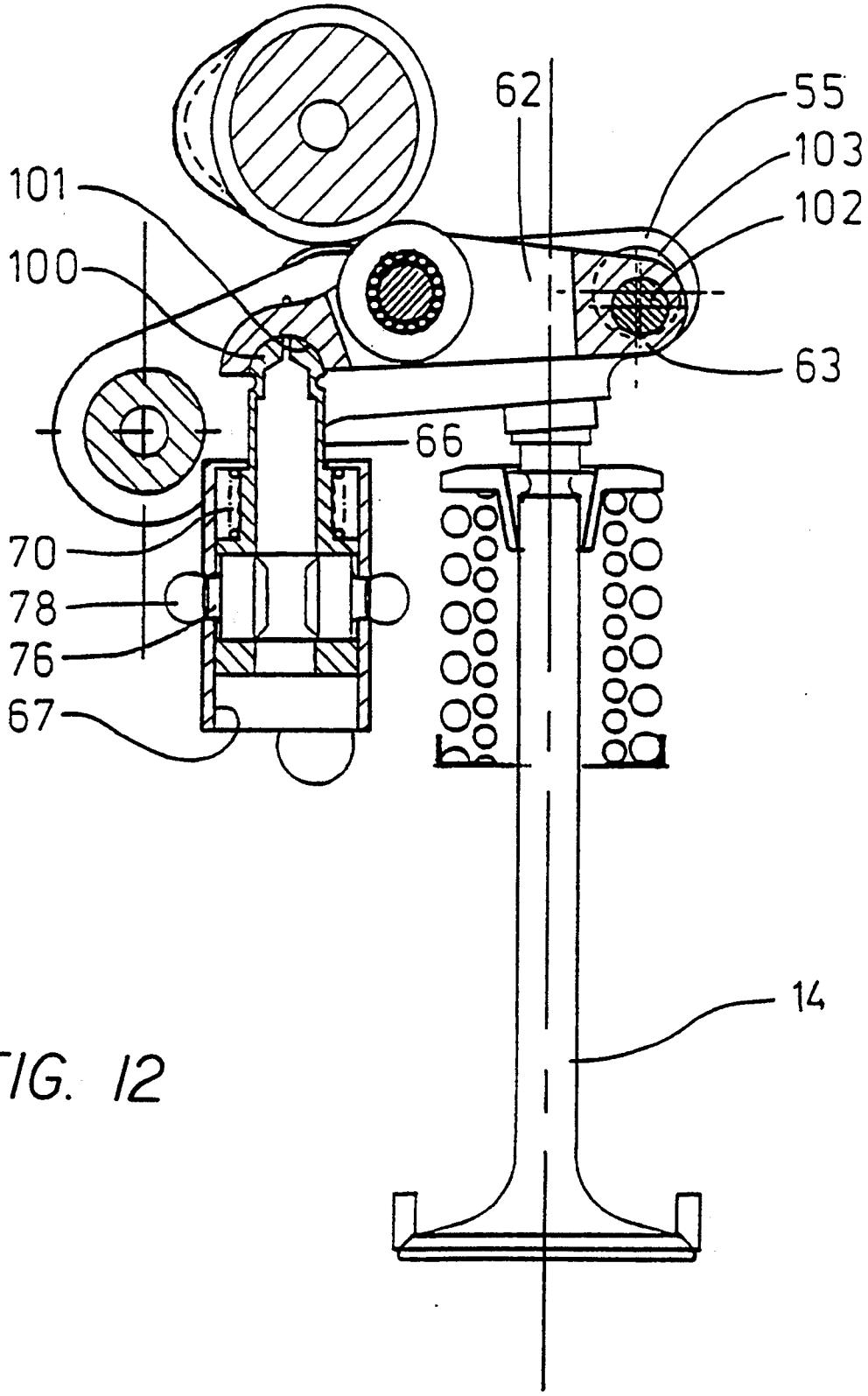

FIGS. 11 and 12 show an arrangement similar to that of FIGS. 1 and 2, except for the way in which piston 66 co-operates with high-lift finger follower 62, and the connection of finger follower 62 with the low-lift finger followers 52 and 53.

Figure 14:
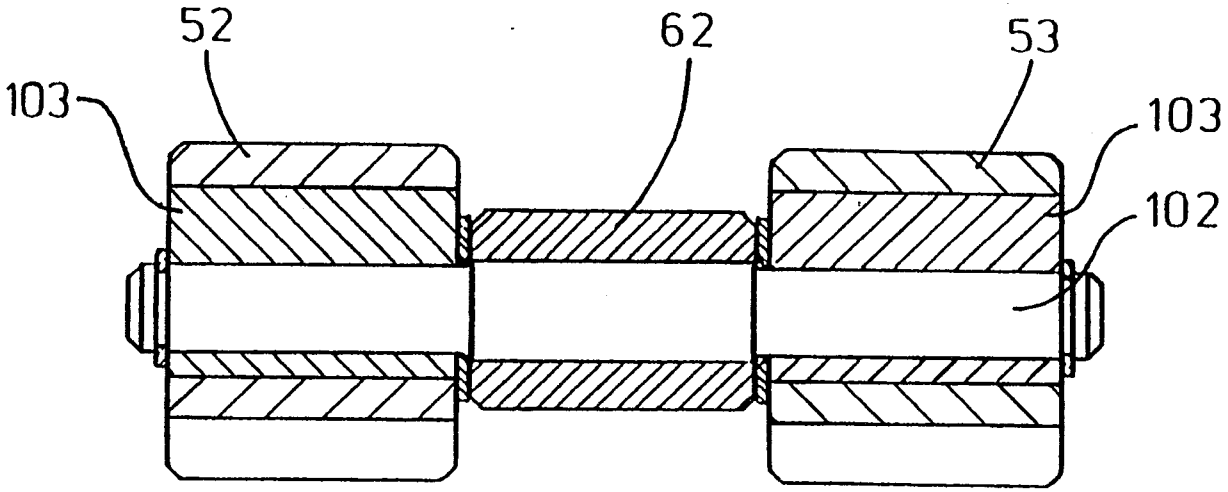
FIGS. 13 and 14 show detail of the embodiment of FIG. 11.
Figure 13:
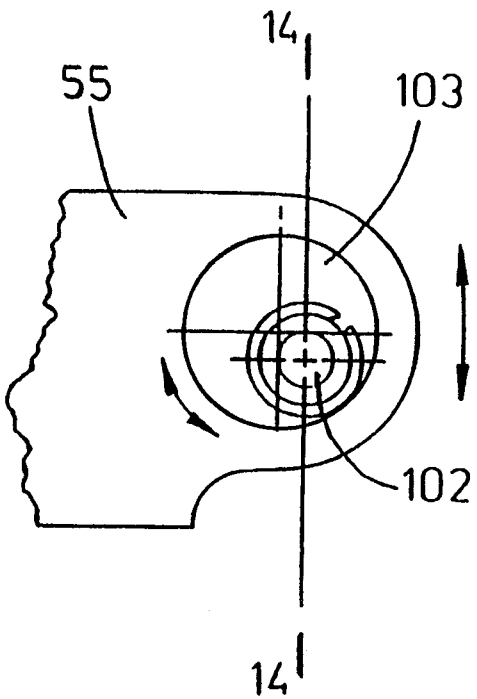

In the embodiment of FIGS. 11 and 12 the piston 66 has a hemispherical upper end 100 and the high-lift finger follower 62 has a mating engagement portion 101 which bears against end 100. The arrangement allows relative rotational movement between the finger follower 62 and the piston 66, but not transverse movement of the finger follower 62 about its contact with the piston 66. The finger follower 62 is connected to finger followers 52 and 53 by a connecting pin 102 and eccentric bushes 103. The eccentric pin 102 and bushes 103, shown in detail in FIGS. 13 and 14, now accommodate the relative transverse motion between finger follower 62 and finger followers 52 and 53.

Figure 15:
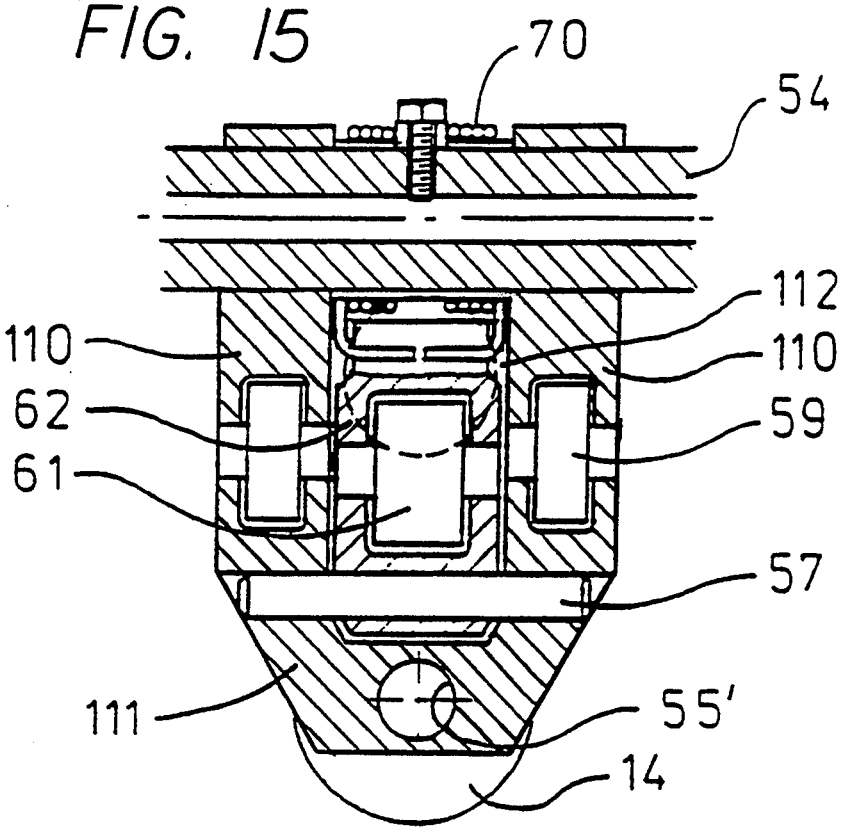
FIGS. 15 and 16 show embodiments of the invention incorporating a single valve.

FIG. 15 shows an embodiment of the invention which has only one valve 14. Two low-lift cams 50 (not shown) co-operate with two low-lift cam followers 59 comprising rollers pivotally mounted on arms 110 of a low-lift finger follower assembly 111. Finger follower assembly 111 is pivotally mounted at one end on the rocker shaft 54 and co-operates with valve 14 at its other end via lash compensation element 56. Finger follower assembly 111 has a central aperture 112 in which a high-lift finger follower 62 is provided. The high-lift finger follower 62 is connected to the low-lift finger follower assembly 111 by cross-member 57 which is received in the arms 110 and comprises a coupling between the high-lift and low-lift finger-followers.

Figure 16:
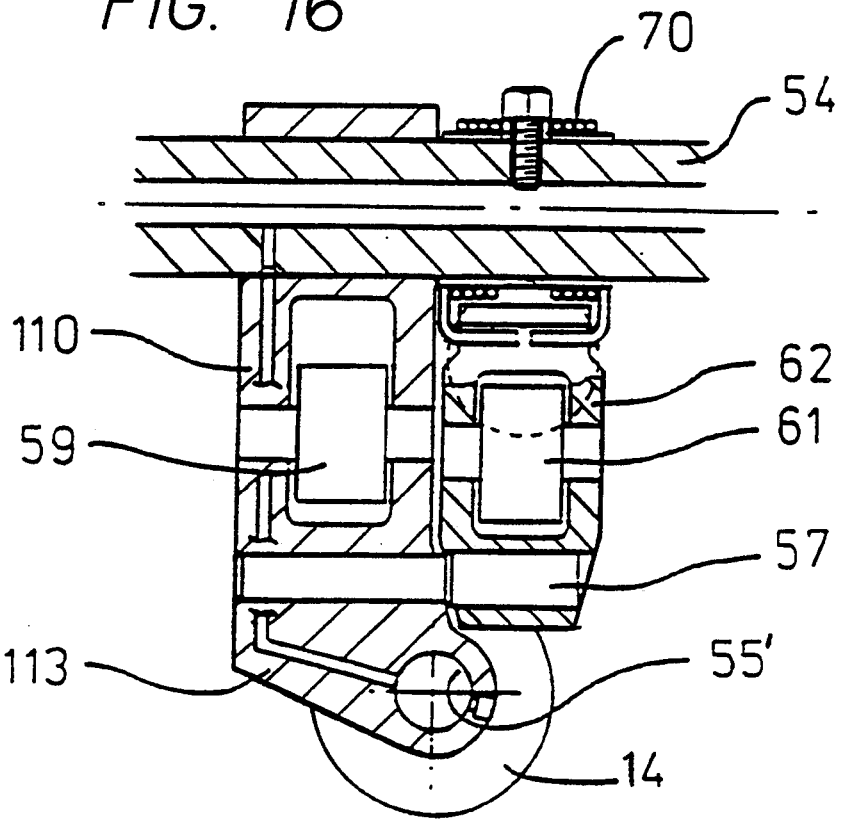

FIG. 16 shows another embodiment having only one valve 14. Only one arm 110 is provided and only one follower 59. The valve-end of arm 110 is cranked at 113 to overlie the valve. High-lift finger follower 62 is once again connected to the low-lift 110 via a connecting pin 57.

Figure 17:
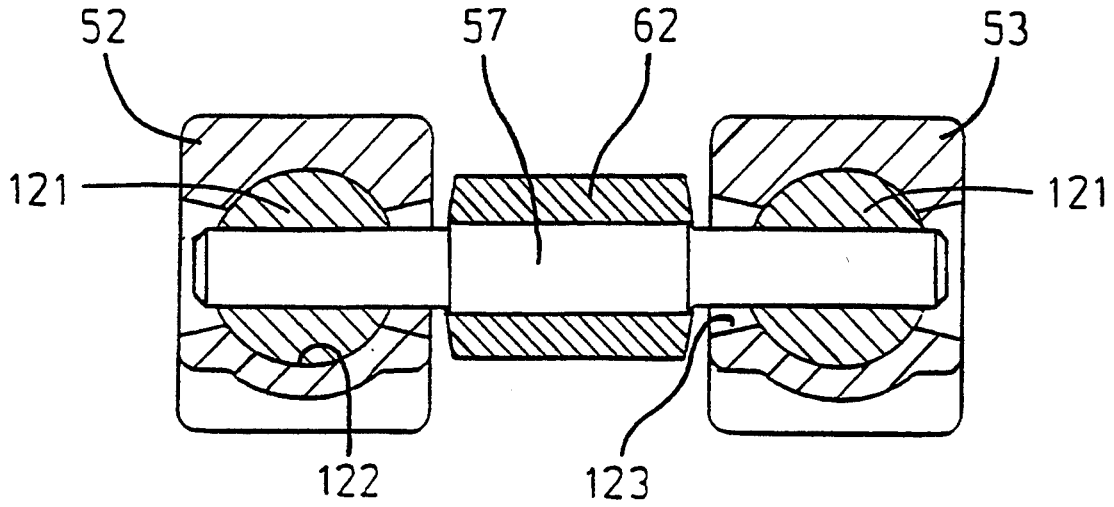
FIGS. 17, 18, 19 and 20 show alternative details of a modified embodiment of the invention.
Figure 18:
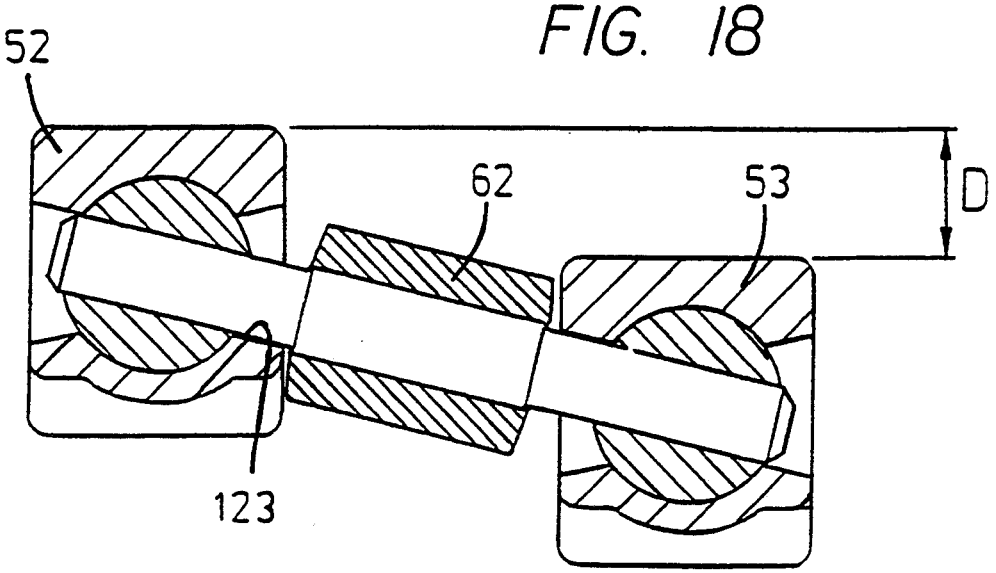

FIGS. 17, 18, 19 and 20 show alternative couplings between a pair of low-lift finger followers 52 and 53 and a high-lift finger follower 62 which is adapted for use with two low-lift cams 50 (co-operating with finger followers 52 and 53) of different cam profiles. In FIGS. 17 and 18 the central, high-lift finger follower 62 carries a connecting pin 57, the finger followers 52 and 53 have cylindrical (or spherical) bushes 121, angularly movable in their seatings 122 in the finger followers, and a coupling cross-member 57 extends in the finger follower 62 and connects the two bushes 121. The finger followers 52 and 53 have stop abutment faces 123 adjacent the central high-lift finger follower 62.

When the high-lift cam controls the valves connected to finger followers 52 and 53 the high lift finger follower 62 controls the movement of the cross-member 57 which moves in a horizontal plane, as shown in FIG. 17. When the low-lift cams 50 are operational they each control their respective finger follower 52 or 53 according to their own cam profiles, with the bushes 121 accommodating the relative movement between the finger followers 52 and 53. The connection of finger follower 62 to, for example, piston 66 must be able to accommodate the twisting of the finger follower 62 as shown in FIG. 18. A spherical, ball-joint, type connection as shown in FIG. 11 or 12 would be suitable.

The finger followers 52 and 53 can be arranged to move entirely independently, or independently within a predetermined range of each other by appropriate selection of the angle of stop abutment faces 123. FIG. 18 shows the maximum lift difference D between the valves for the low-lift cam profiles. If the angle of faces 123 is made greater a greater difference D can be obtained.

Figure 19:
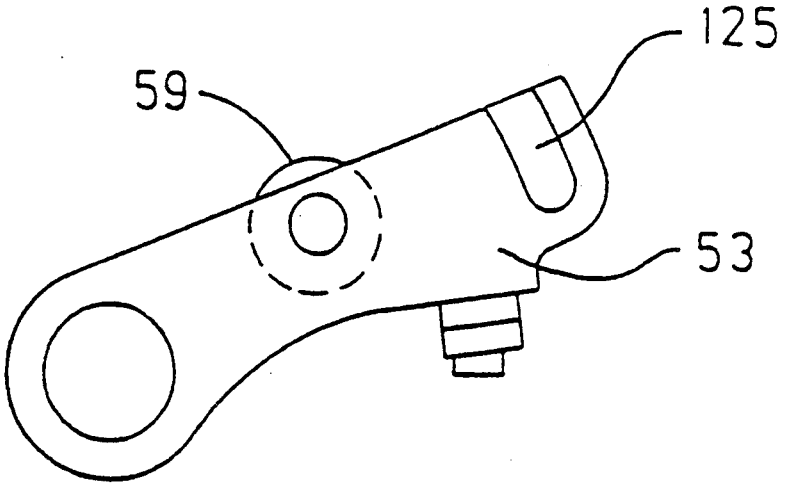
Figure 20:
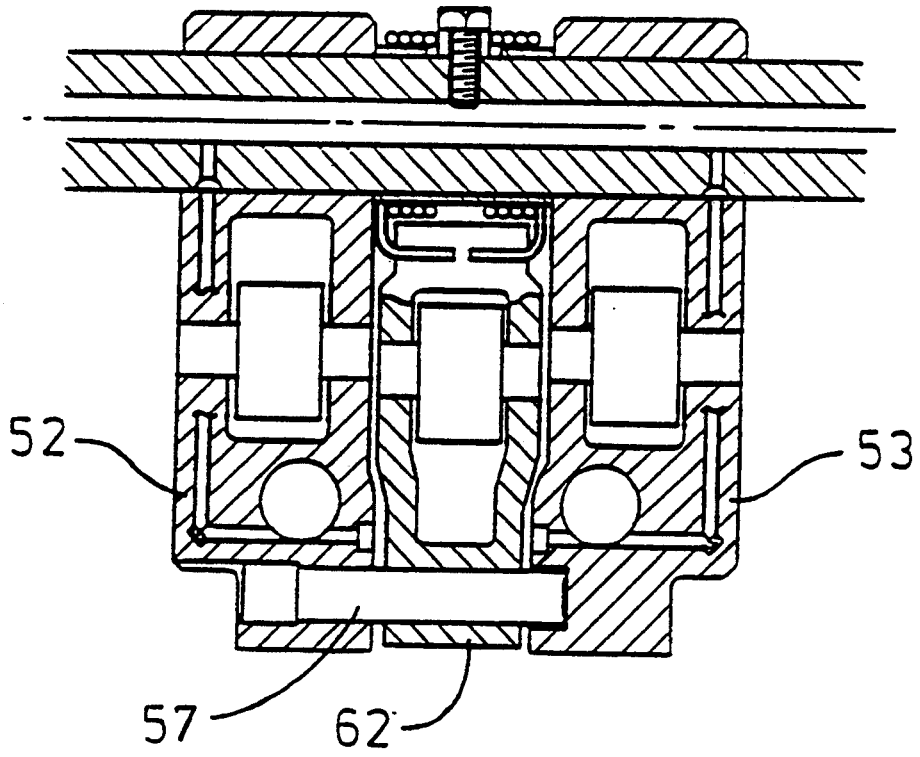

In FIGS. 19 and 20 the relative difference between lifts of the low-lift cams 50 is accommodated by a lost motion slot 125 in one of the low lift finger followers 53. Thereby allowing finger follower 53 the option of greater lift than finger follower 52. High lift finger follower 62 is permanently pivotably connected to finger follower 52 via connecting pin 57, but only cooperates with finger follower 53 when high lift cam 51 is operative, controlling both valves 14 and 15 via finger follower 62 and connecting pin 57.

One possibility with the embodiment of FIGS. 17, 18, 19 and 20 is to arrange for one of the low-lift cam profiles to have no lift at all, thus de-activating the corresponding valve during low-lift operation (low engine speed range). Both finger followers 52 and 53, and hence the valves 14, would be activated together again during high-lift operation (high engine speed).

More than two low-lift finger followers could be provided, and they may have cams of more than two different cam profiles.

It will be clear that there can be many combinations of the modifications described.

We claim:

1. An internal combustion engine having valve means and a cam mechanism for controlling the valve means comprising camshaft means having first and second cam means mounted thereon for rotation therewith and first and second finger followers rockable about fulcrum means, wherein the first finger follower has first follower means arranged to follow the surface of the first cam means when the first finger follower is held in engagement with the first cam means, the second finger follower has a first end portion, an intermediate portion and a second end portion, the second finger follower being pivotally connected at the first end portion thereof to the first finger follower and the second finger follower having arranged in the intermediate portion thereof second follower means arranged to follow the surface of the second cam means when the second finger follower is held in engagement with the second cam means, the first cam means, the first follower means and the first finger follower comprise a first short duration cam mechanism for low speeds of the engine, the second cam means, the second follower means and the second finger follower comprise a second long duration cam mechanism for high speeds of the engine, the fulcrum means comprises movable fulcrum means on which the second finger follower is mounted at the second end portion thereof, said movable fulcrum means being movable between a first position wherein the second follower means is out of engagement with the second cam means and a second position where the second follower means is in engagement with the second cam means, and the fulcrum means comprises fixed fulcrum means about which the first finger follower is rockable for all positions of the movable fulcrum means.

2. An internal combustion engine as claimed in claim 1 wherein the first follower means of the first finger follower engages the base circle of the first cam means irrespective of whether the second follower means is in or out of engagement with the second cam means.

3. An internal combustion engine as claimed in claim 1 in which the fulcrum means for the second cam mechanism comprises an actuator piston movable between two positions in a bore in response to changes in pressure in a chamber beneath the piston.

4. An internal combustion engine as claimed in claim 3 in which latching means is provided to latch the actuator piston releasably in either of the first or second positions thereof.

5. An internal combustion engine as claimed in claim 4 in which the latching means comprises a latching piston movable in a direction transversely of the actuator piston and engageable with a recess in the bore.

6. An internal combustion engine as claimed in claim 1 in which a pair of adjacent valves are driven by individual finger followers provided in the first cam mechanism, the second cam mechanism having a single finger follower operable to drive both of the adjacent valves.

7. An internal combustion engine as claimed in claim 1 wherein the first cam means comprises two separate cams of the same profile spaced apart on the camshaft means, the second cam means comprises a cam interposed between the two cams of the first cam means, and a third finger follower having a third follower means is provided in the first cam mechanism, said third finger follower being rockable about the fixed fulcrum means, the fixed fulcrum means holding the third follower means in engagement with one of the cams of the first cam means and the valve means, and said third follower means engaging one of the cams of the first cam means when the first follower means of the first finger follower engages the other cam of the first cam means.

8. An internal combustion engine as claimed in claim 6 in which two finger followers of the first cam mechanism are joined together adjacent where they make driving engagement with the valve means by a link member extending parallel to the camshaft means and the second finger follower is pivotally connected to the two said finger followers by the link member and drives the link member when the second cam follower means engages the second cam means.

9. An internal combustion engine as claimed in claim 7 in which two finger followers of the first cam mechanism are joined together adjacent where they make driving engagement with the valve means by a link member extending parallel to the camshaft means and the second finger follower is pivotally connected to the two said finger followers by the link member and drives the link member.

10. An internal combustion engine as claimed in claim 1 wherein the first cam means comprises two separate cams of two different profiles spaced apart on the same camshaft means, the second cam means comprises a cam interposed between the two cams of the first cam means, the valve means comprises a pair of adjacent valves, the first finger follower is held in engagement with a first of the pair of valves, a third finger follower is provided which has third follower means, said third finger follower being rockable about the fixed fulcrum means, the fixed fulcrum means can hold the third follower means in direct or indirect engagement with one of the cams of the first cam means and with the second of the pair of valves, and the first follower means is engageable with one of the cams of the first cam means, and the third follower means is engageable with the other cam of the first cam means, whereby when the movable fulcrum means is in the first position, the first of the pair of valves is driven by the first finger follower following a first cam profile, and the second of the pair of valves is driven by the third finger follower following a different cam profile, and when the movable fulcrum means is in the second position both valves of the pair of valves are driven by the second finger follower following the profile of the second cam means.

11. An internal combustion engine as claimed in claim 1 wherein the fixed fulcrum means is a rocker shaft.

12. An internal combustion engine as claimed in claim 1 wherein the first finger follower has a first end portion, a second end portion and an intermediate position, the first finger follower being pivotally mounted at the first end portion thereof on the fixed fulcrum means, the first follower means being provided in the intermediate portion of the first finger follower and the second end portion of the first finger follower member engaging the valve means or means for transmitting reciprocal motion to the valve means.

13. An internal combustion engine as claimed in claim 6 wherein the finger followers of the first cam mechanism are provided with eccentric bushes and the link member comprises a connecting pin mounted in the eccentric bushes.

14. An internal combustion engine as claimed in claim 10 wherein the first and third finger followers each have a cylindrical or spherical bush angularly movable in a seating provided in the first and third finger followers and a coupling cross-member connects the two bushes and links the first, second and third finger followers together, the bushes accommodating relative movement between the first and third finger followers.

15. An internal combustion engine as claimed in claim 10 wherein the third cam means has a lift greater than the first cam means and less than the second cam means, the third finger follower is provided with a lost motion slot and a connecting pin links the first and second finger followers and is movable in the lost motion slot of the third finger follower.

* * * * *